United States Patent [19]

Pogonowski et al.

[11] 3,954,610

[45] May 4, 1976

[54] METHOD AND SUBSURFACE WORK CHAMBER FOR MAKING TRANSPARENT AN UNDERWATER CLOUDY WORK AREA

[75] Inventors: Ivo C. Pogonowski, Blacksburg, Va.; Paul D. Carmichael, Houston, Tex.

[73] Assignee: Texaco, Inc., New York, N.Y.

[22] Filed: Aug. 19, 1974

[21] Appl. No.: 498,344

Related U.S. Application Data

[62] Division of Ser. No. 355,115, April 27, 1973, Pat. No. 3,854,296.

[52] U.S. Cl. ..... 210/65; 61/69 R; 210/170

[51] Int. Cl.[2] ..... B01D 37/00; B63C 11/00

[58] Field of Search ..... 210/65, 76, 167–170, 210/196; 61/69 A

[56] References Cited

UNITED STATES PATENTS

| | | | |
|---|---|---|---|
| 3,239,438 | 3/1966 | Voorhers | 210/167 X |
| 3,324,829 | 6/1967 | DeJose et al. | 210/169 X |
| 3,344,614 | 10/1967 | Brck | 61/69 R |
| 3,482,903 | 12/1969 | Thomas et al. | 61/69 R X |

*Primary Examiner*—John Adee
*Attorney, Agent, or Firm*—T. H. Whaley; C. G. Ries; Theron H. Nichols

[57] ABSTRACT

A method for making transparent an underwater work area covered with cloudy water for servicing an offshore well and a subsurface well servicing and life supporting work chamber for practicing the method comprising a submarine chamber rotatably mounted on a base positioned centrally of a group of wells around the periphery of the base is disclosed. The chamber has a water filter and an ejection nozzle for ejecting clear water from the filter into an underwater cloudy area over a well to be serviced for providing a relatively transparent area of clear water to see through and work in.

6 Claims, 2 Drawing Figures

METHOD AND SUBSURFACE WORK CHAMBER FOR MAKING TRANSPARENT AN UNDERWATER CLOUDY WORK AREA

This is a division of application Ser. No. 355,115, filed Apr. 27, 1973 now issued as U.S. Pat. No. 3,854,296 on Dec. 17, 1974.

BACKGROUND OF THE INVENTION

For servicing offshore oil and gas wells, expensive submarines or fixed submersible work chambers or buoyant capsules have been proposed as illustrated in U.S. Pat. Nos. 3,638,720; 3,643,736; and 3,656,549, but which have not been too satisfactory. Workers in the chambers have had difficult times getting to the actual well and have had to resort to small submarines as shown in U.S. Pat. No. 3,469,627 or to skin diving as suggested by U.S. Pat. No. 3,664,423.

Offshore operations in deep water face the additional problem of collapsing of the shell when lowered to the sea bottom due to the high hydrostatic pressure thereon. Large submarine hulls with self-propulsion systems are very costly and dangerous because of the ever possibility of drifting into deep waters where the pressure is greater than what the submarines are structurally capable of withstanding.

Large diameter flooded bells or chambers are massive and expensive for being lowered over one of several wells for being pumped dry of sea water and pressurized with air for forming a working chamber therein as suggested in U.S. Pat. No. 3,656,549 referred to above, or U.S. Pat. No. 3,602,301.

If the sea or bottom water is muddy, either usual operations are suspended or the work is done blind and very slowly as the operators feel in the dark.

OBJECTS OF THE INVENTION

Accordingly, a primary object of this invention is to provide a method for making transparent a subsurface sea bottom work area that is covered with cloudy, turbid, or muddy water.

Another primary object of this invention is to provide a subsurface well servicing and life supporting work chamber for housing workers for practicing the above method and for enabling the workers to work in underwater work areas covered with turbid or cloudy water.

A further object of this invention is to provide a subsurface housing or work chamber for making transparent an underwater area covered with cloudy water so that workers in the housing can clearly see to work in the area.

A still further object of this invention is to provide a subsurface life supporting work chamber for underwater workers when clearing a working area of cloudy water that is easy to operate, is of simple configuration, is economical to build and assemble, and is of greater efficiency for clearing cloudy unworkable work areas.

Other objects and various advantages of the disclosed methods and subsurface chamber for practicing the methods will be apparent from the following detailed description, together with the accompanying drawings, submitted for purposes of illustration only and not intended to define the scope of the invention, reference being had for that purpose to the subjoined claims.

BRIEF DESCRIPTION OF THE DRAWINGS

The drawings diagrammatically illustrate by way of example, not by way of limitation, a few forms or mechanisms to practice the methods of the invention wherein like reference numerals have been employed to indicate similar parts in the several views in which.

DESCRIPTION OF THE INVENTION

The invention disclosed herein, the scope of which being defined in the appended claims, is not limited in its application to the details of construction and arrangement of parts shown and described for practicing the disclosed methods, since the invention comprises other methods and is capable of providing other embodiments for being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE METHODS

This invention comprises new methods for making transparent a subsurface work area covered with cloudy water.

The basic method comprises the step of:

1. ejecting clear water over the cloudy water covered work area to displace the cloudy water with the clear water to provide a transparent water covered work area.

In greater detail the above method may be expressed in the following method steps:

1. filtering adjacent water to provide clear transparent water, and
2. displacing the cloudy water from over the work area with the clear water to provide a transparent water covered work area.

In still greater detail the above methods may be expressed in the following method steps:

1. ingesting water from adjacent to the subsurface well servicing and life supporting work chamber,
2. filtering the ingested water to provide clear water, and
3. ejecting the clear water over the cloudy water covered work area to displace the cloudy water with the clear water to provide a transparent water covered work area.

DESCRIPTION OF AN APPARATUS

Figure 1:
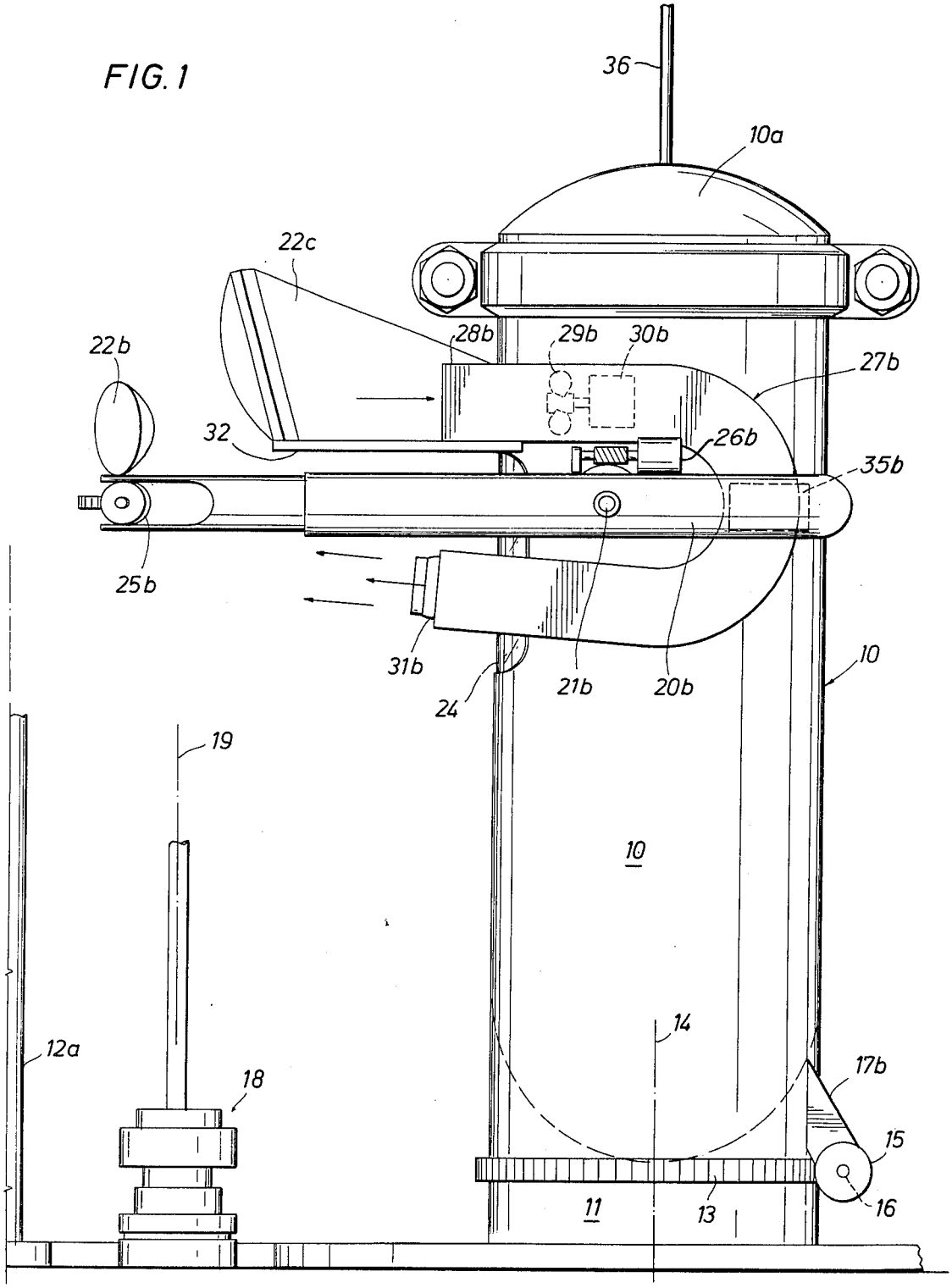
FIG. 1 is a schematic vertical side view of a basic embodiment of the invention.
Figure 2:
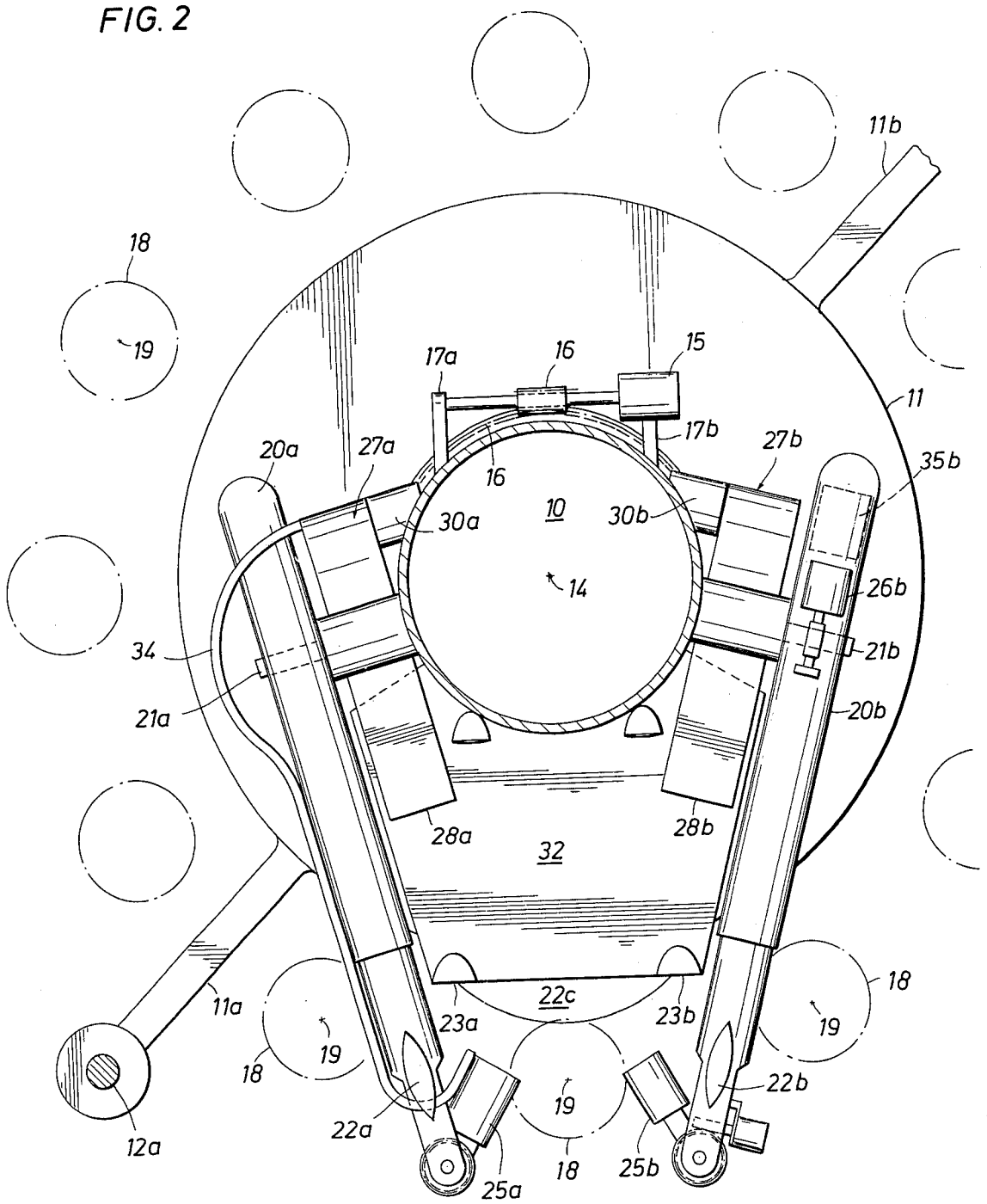
FIG. 2 is a schematic plan view of the embodiment of FIG. 1.

While various devices may be utilized for carrying out or practicing the inventive methods, FIGS. 1 and 2 illustrate at least one inventive apparatus for practicing the methods described above.

FIG. 1, a vertical side view of the new apparatus illustrates a subsurface well servicing and life supporting work chamber 10 rotatably mounted on a base 11, which base has arms **11*a*, 11*b*, all slideable on vertical guide rails 12*a*, 12*b* extending vertically from the sea bottom to the surface. A hatch 10*a*** provides egress and ingress to the work chamber for the workers.

Conventional clamps (not shown) are mounted internally of base 11 for releasably securing the work chamber at any position or depth along the vertical rails **12*a***, 12*b*, as controlled by operators inside the work chamber 10 as suggested in "Ocean Industry", August, 1972, by the Gulf Publishing Co., Houston, Tex., pages 45–46.

Base 11, FIGS. 1 and 2, includes a tool rack and supply area for the workers in the work chamber 10 from which tools may be picked up with telescopic robot arms described below. A ring gear of helical teeth 13 is mounted around the periphery of the bottom of the enclosure 10. Conventional bearings (not shown) are mounted between the ring gear 13 on the bottom of the enclosure and the top of the base 11 to permit rotation of the work chamber 10 about its vertical longitudinal axis 14. A reversible electric motor 15 and a single helix worm 16 driven thereby are mounted on the bottom of work chamber 10 with struts or legs 17*a*, 17*b*. Thus rotating worm 16 pulls itself and work chamber 10 around ring gear teeth 13 for rotating the work chamber about its axis 14 in either direction to face any of the twelve, or so, wellheads 18, FIG. 2, spaced around the periphery of base 11. Center line 19, FIG. 1, of a wellhead 18 indicates the center of work areas described hereinafter.

Two telescopic robot arms 20*a*, 20*b*, FIG. 2, are spaced from and pivotally mounted to opposite sides of the well servicing and life supporting work chamber 10, pivot 21*b*, FIG. 1, being illustrated for supporting arm 20*b*. The two telescopic arm pivots 21*a* and 21*b*, FIG. 2, are positioned horizontally opposite to each other. Remote control closed circuit television cameras 22*a*, 22*b* are universally pivotally mounted on the respective ends of the two telescopic arms 20*a* and 20*b*.

Another closed circuit television camera 22*c* with flood lights 23*a*, 23*b* mounted on each side thereof is mounted on the front wall portion of the operator's enclosure between the telescopic arms 20*a*, 20*b*. An observation window 24 is provided in the front wall of the work chamber 10 for viewing of the lighted work area by the operators therein.

Connected to the outer extremities of the telescopic arms 20*a*, 20*b*, FIGS. 1, 2, socket tool grip connections 25*a*, 25*b*, respectively, similar to those shown in the subsea diving bell disclosed in "Ocean Industry", supra, but with electromagnets combined therewith for gripping and using all conventional tools from a tool rack (not shown) on the base 11 for remote operation in the working area from control inside of the work chamber 10. The robot arms 20*a*, 20*b* are each individually pivotal about its pivot 21*a*, 21*b*, respectively, by its motor and pump combinations 35*a* (not shown) and 35*b*, and telescopically extendible with actuating motors 26*a* (not shown), 26*b*, FIG. 1, for remotely picking up tools and working in the working area of one of the wellheads 18, for example.

Filter assemblies, 27*a*, 27*b*, FIGS. 1, 2, are the main features of this invention for making a very efficient subsurface well servicing and life supporting work chamber operable in all types of water, particularly cloudy, muddy, murky, or turbid water. Both filter assemblies 27*a*, 27*b* are fixedly mounted on opposite sides of the well servicing and life supporting work chamber 10 between the telescopic arms 20*a*, 20*b*. As illustrated in the side view of FIG. 1, the left filter assembly 27*b*, for example, comprises an inlet or intake duct 28*b* for drawing in cloudy or turbid water of any type, regardless of how dirty it is, a water pump 29*b* and electric motor 30*b* for driving the pump, a suitable clarifier or filter internally of filter assembly 27*b*, and an outlet duct and adjustable nozzle 31*b* for ejecting clear, transparent water over the desired work area. The water pump may be reversible for backwashing. While the above described filter assembly is illustrated as being fixed to the work chamber 10, it may be pivotally mounted thereto if so desired and required for the particular work chamber.

A transparent baffle plate 32, FIGS. 1 and 2, is mounted between the cloudy water intake 28*b*, FIG. 1, and the clear water exhaust nozzle 31*b*, and preferably attached to the undersurface of the intake ducts 28*a*, 28*b* of both filter assemblies and to the adjacent wall surface of work chamber 10 for separating the inlet and outlet ducts for preventing recirculation of clear water from outlet duct and nozzle 31*b* directly to water intake duct 28.

A clear water supply hose and nozzle 34 comprising a small water ejection means is mounted on one of the robot arms 20*a* for clearing the portion of the work area at the tool being held by the robot arm for clarity of visibility.

Umbilical line 36 provides all necessary supplies to the workers inside the work chamber.

In operation while exhaust nozzle 31*b*, FIG. 1, is movable to a limited degree for fine adjustments in directing the clear water stream, the principal method of directional control of the clear water over the work area is by releasing the clamps (not shown) on the rails 12*a*, 12*b*, and raising or lowering the work chamber and base on cable 36 on vertical longitudinal axis 14 by conventional winch means (not shown) in the work chamber, reattaching the clamps for fixing the base 11 at the proper depth, and revolving the work chamber 10 relative to the base by actuation of motor and worm gear 15, 16 to position the work chamber for facing the particular wellhead and work area desired. Then the clear water filter or clear water generating system is actuated to displace the cloudy water with clear water to make a transparent water covered work area followed by actuation of the lights and closed circuit television cameras to assist the operators in the operation of their robot telescopic tool carrying arms 20*a*, 20*b* in the work area.

Accordingly, it will be seen that the above described methods for making transparent a subsurface work area covered with cloudy water and a subsurface work chamber for practicing the above methods are set forth above which will operate in a manner which meets each of the objects set forth hereinbefore.

While only a few methods of the invention and one mechanism for practicing the methods has been disclosed, it will be evident that various other methods and modifications are possible in the arrangement and construction of the disclosed invention without departing from the scope of the invention and it is accordingly desired to comprehend within the purview of this invention such modifications as may be considered to fall within the scope of the appended claims.

We claim:

1. A method for making transparent a subsurface work area covered with cloudy water on the sea bottom adjacent to a subsurface well servicing and life supporting work chamber comprising the steps of, a. ingesting water from a level adjacent to the subsurface well servicing and life supporting work chamber, b. filtering the ingested water to provide clear water, and c. ejecting the clear water into the cloudy water covered work area at a level below the ingesting level to displace the cloudy water with the clear water to provide a transparent water covered work area.

2. A method for making transparent a subsurface work area covered with cloudy water comprising the steps of, a. filtering a layer of adjacent water to provide clear transparent water, and b. injecting the clear transparent water into the subsurface work area below the layer of adjacent water for displacing the cloudy water from over the work area with the clear water to provide a transparent water covered work area.

3. A method for making transparent a subsurface work area covered with cloudy water comprising the step of, a. ejecting clear water under the cloudy water covered work area to displace the cloudy water upwardly with the clear water to provide a transparent water covered work area.

4. A method as recited in claim 1 comprising the additional prior method step of, a. partially dividing the subsurface work area into two layers with a transparent baffle plate for limiting mixing of the cloudy water of one layer with any clean and clear water injected into the other layer.

5. A method for making transparent a subsurface work area covered with cloudy water comprising the steps of, a. partially dividing the cloudy water covered work area into two portions with a baffle plate, b. filtering water from one of the portions to provide a clear transparent water, and c. displacing the cloudy water from over the work area in the other portion with the clear water to provide a transparent water covered work area.

6. A method for making transparent a subsurface work area covered with cloudy water comprising the steps of, a. partially dividing the cloudy water into two portions with a baffle plate, and b. ejecting clear water into the cloudy water of one portion to gradually displace the cloudy water in the other portion with the clear water to provide a transparent water covered work area.

* * * * *